United States Patent [19]
Hawthorne, Marion F.
[11] 3,967,989
[45] July 6, 1976

[54] HIGH ENERGY PROPELLANT COMPOSITIONS INCLUDING VINYL DECABORANE-POLYESTER COPOLYMER BINDER

[75] Inventor: Marion F. Hawthorne, Huntsville, Ala.

[73] Assignee: Rohm and Haas Company, Philadelphia, Pa.

[22] Filed: Nov. 3, 1959

[21] Appl. No.: 851,935

Related U.S. Application Data

[63] Continuation-in-part of Ser. No. 783,614, Dec. 29, 1958, abandoned.

[52] U.S. Cl. ..... 149/19.2; 149/19.5; 149/19.91; 149/20; 149/88; 260/606.5 B

[51] Int. Cl.[2] ..... C06D 5/06

[58] Field of Search ..... 52/.5; 260/89.5, 486, 260/606.5; 149/19.2, 20, 19.5, 19.91

[56] References Cited

UNITED STATES PATENTS

| | | | |
|---|---|---|---|
| 3,266,958 | 8/1966 | Breazeale et al. | 149/19.2 |
| 3,362,860 | 1/1968 | D'Alelio | 149/19.2 |

*Primary Examiner*—Benjamin R. Padgett
*Assistant Examiner*—E. A. Miller

[57] ABSTRACT

This invention concerns high energy propellants containing boron compounds which are suitable for use as propellants.

10 Claims, No Drawings

HIGH ENERGY PROPELLANT COMPOSITIONS INCLUDING VINYL DECABORANE-POLYESTER COPOLYMER BINDER

This application is a continuation-in-part of Ser. No. 783,614, filed Dec. 29, 1958, and now abandoned.

Boron compounds are of particular interest as components of propellant charges, such as are used in missiles, rockets, etc., because they are high energy compounds, and, when used with oxidizers and other additives, provide very high specific impulse, a much sought after characteristic. However, the simpler boron compounds tend to be unstable, and more stable boron compounds have long been sought.

While it would be possible to incorporate stable boron compounds into propellant compositions without chemically reacting the boron compounds with the other components of the propellant charge, there are serious limitations on the amount of a boron-containing compound which can be incorporated if it does not react to form a polymeric compound with good physical properties. There are definite lower limits to the physical properties which a propellant grain must possess, and, because of the necessity for using high proportions of an oxidizer such as ammonium perchlorate, many of the propellant grains presently used are not substantially above these minimum requirements. Thus the addition of any appreciable amount of boron-containing compounds which do not contribute to the physical strength of the grain is frequently impossible. Boron-containing compounds which would yield polymers having good physical properties by polymerization or by condensation reactions would therefore be most desirable.

One preferred method of making propellant "grains" or charges consists in casting a mixture of various additives plus a compound, which can be termed a "monomer", which will subsequently form an elastic tough rubbery polymer by condensation or polymerization reactions and functions as a binder for the entire propellant charge. This method permits uniform dispersion of all components throughout the propellant mass and, more important, permits casting the mixture into casings or molds at relatively low safe temperatures. Obviously, with potentially explosive or highly combustible mixtures such as must be used for high energy propellants, the ability to cast these compositions satisfactorily at relatively low temperatures is a tremendously important safety factor. After casting, the monomeric compound is reacted to form a polymer, which polymer, as hereinbefore set forth, functions as a binder for the entire propellant charge.

An object of the present invention is to make available stable propellants having very high boron content.

Because of the newness of the entire field of boron chemistry, the nomenclature for boron compounds is still in a state of flux. For the purposes of the present invention, a specific system of nomenclature has been adopted for simplification. This nomenclature will be used throughout the specification and the claims and, when explained as set forth below, will be completely understandable to those skilled in the art. The nomenclature employed is as follows:

| | | | | |
|---|---|---|---|---|
| $HC(B_{10}H_{10})CH$ | = | $H\text{Ø}H$ | = | dekene |
| $HC(B_{10}H_{10})C-$ | = | $H\text{Ø}$ | = | dekenyl radical |
| $-C(B_{10}H_{10})C-$ | = | $\text{Ø}$ | = | dekinyl radical |

The compound, dekene, as shown above, has also been given the trivial name of "vinylene decaborane". This name does not describe the actual structure of the compound any more accurately or precisely than the trivial name "dekene".

The dekenyl products used in the propellants of the present invention are made by reacting hydroxy dekenyl compounds with the acyl halides of acrylic and methacrylic acids, the halogen of said halide having an atomic weight from 35 to 80. The corresponding dekenyl acrylates and dekenyl methacrylates are formed. The acid chlorides of acrylic and methacrylic acids are generally used for reasons of economy and availability, but the acid bromides are equally effective.

Suitable hydroxy dekenyl compounds which can be employed include the following:

| | |
|---|---|
| Bis(dekenylmethyl) carbinol | $(H\text{Ø}CH_2)_2—CHOH$ |
| Didekenyl carbinol | $(H\text{Ø})_2—CHOH$ |
| Dekenyl methanol | $H\text{Ø}—CH_2OH$ |
| 2-Dekenyl ethanol | $H\text{Ø}—(CH_2)_2—OH$ |
| 3-Dekenyl propanol-1 | $H\text{Ø}—(CH_2)_3—OH$ |
| 4-Dekenyl butanol-1 | $H\text{Ø}—(CH_2)_4—OH$ |
| 5-Dekenyl pentanol-1 | $H\text{Ø}—(CH_2)_5—OH$ |
| Bis(methyldekenyl) carbinol | $(CH_3\text{Ø})_2—CHOH$ |

These hydroxy dekenyl compounds can be prepared by a number of methods. Thus, bis(dekenylmethyl) carbinol can be prepared by reacting dekenylmethyl bromide with magnesium to form the Grignard complex ($H\text{Ø}CH_2MgBr$) and reacting two moles of the Grignard complex with ethyl formate to form the carbinol. Didekenyl carbinol can be prepared by reacting acetylene with decaborane to form dekene, treating the dekene with phenyllithium dekene with one mole of ethyl formate to form didekenyl carbinol. Didekenyl carbinol can also be prepared by treating the acetate of diethynyl carbinol with decaborane and hydrolyzing the acetate of didekenyl carbinol so formed. Dekenyl carbinol can be prepared by reacting 3-acetoxypropyne-1 with decaborane to form dekenylmethyl acetate, followed by hydrolysis to form dekenyl carbinol. In the general formula $H\text{Ø}(CH_2)_nOH$, $n=2$ can be formed by treating 4-acetoxybutyne-1 and $n=3$ can be formed by treating 5-acetoxypentyne-1 using the same process set forth hereinbefore for 3-acetoxypropyne-1. These acetoxy acetylene derivatives are commercially available. The higher homologues can be prepared by the same process. The compounds $n=2$ and $n=3$ in the formula $HD(CH_2)_nOH$ can be prepared by an alternate process as follows: propargyl bromide ($CH \equiv C—CH_2Br$) is reacted with decaborane to form dekenylmethyl bromide. This bromide is reacted with magnesium to form the Grignard complex which is subsequently reacted with formaldehyde to form 2-dekenyl ethanol or with ethylene oxide to form 3-dekenyl propanol-1. Dimethyloldekene can be prepared by reacting 1,4-diacetoxybutyne-2 with decaborane to form bis(acetoxymethyl) dekene, and subsequently hydrolyzing the bisacetoxy derivative to dimethyloldekene.

Dekenyl acrylates and methacrylates are prepared by reacting the hydroxy dekenyl compounds set forth hereinbefore with acryloyl or methacryloyl halides. One common method comprises reacting the hydroxy dekenyl compounds with the acryloyl or methacryloyl halide in solution in an inert solvent, i.e. in a solvent which is a non-reactive with the hydroxy dekenyl compound, the acryl halide or the resulting ester, such as acetonitrile, dioxane, methylene chloride, chloroform, acetone, methyl ethyl ketone, or ethylene dichloride, in the presence of an organic base. While triethylamine represents the most economical amine, other lower trialkylamines, other than trimethylamine, can be used. These include tripropylamine, tributylamine, butyldimethylamine, triamylamine, amyldiethylamine and amyldimethylamine. The ratio of amine to acid halide must be at least 1 to 1, and a slight excess of amine is preferred. Thus, the ratio can be 1.5 to 1 or even as high as 4 to 1, but large excesses, such as at a ratio of 4 to 1, do not show any appreciable advantages and do not represent preferred embodiments. Sufficient solvent is used to give readily stirrable reaction mixtures, and although larger quantities of solvents can be used, there is little, if any, advantage to be gained.

Another process for the preparation of dekenyl acrylates and methacrylates comprises treating the hydroxy dekenyl compounds with a hydrocarbon lithium compound and treating the complex so formed with acryloyl or methacryloyl halide. The molar ratio of hydroxy compound to the hydrocarbon lithium compound used is 1 mole of the hydrocarbon lithium compound per mole of hydroxyl group in the hydroxy compound.

A wide variety of hydrocarbon lithium compounds can be used in the hereinbefore-described process for the preparation of dekenyl acrylates and methacrylates. Thus, alkyllithium compounds, such as propyllithium and butyllithium, are satisfactory. Aryllithium compounds represent the preferred type, but, in general, any hydrocarbon lithium compound can be used. Typical aryllithium compounds include diphenylmethane lithium, trityl-(i.e., triphenylmethane) lithium, fluorenyllithium and naphthalenelithium. Phenyllithium represents a particularly preferred lithium compound.

For some reason, as yet unexplained, the hydrocarbon lithium compound method of preparation yields purer compounds, lighter colored, more easily worked up.

While large excesses of the acid halide can be used without altering the nature of the reactions, any excess must be removed and constitutes an unnecessary disadvantage. Molar ratios of hydroxyl to acid halide may be as high as 1 to 2, but a preferred embodiment employs only a 10% to 15% excess of acid halide.

The dekenyl acrylate or dekenyl methacrylate monomers may be used as homopolymers or they may advantageously be used as comonomers. Vinyl trinitratopentaerythritol ether is of particular interest as a comonomer for use in propellant charges, since the copolymer exhibits improved physical properties when used as a binder for propellant charges. Many of these acrylate or methacrylate monomers are relatively high melting solids. Thus, the acrylate prepared by reacting bis(-dekenylmethyl) carbinol with acryloyl chloride melts at approximately 150° C. Since it is preferred to cast propellant charges at about 70° c., it is necessary to lower the melting point by copolymerizing with a lower melting (or a liquid) monomer or by the use of plasticizers.

Other suitable comonomers include methyl acrylate, ethyl acrylate, butyl acrylate, 2-ethylhexyl acrylate and the higher alkyl esters of methacrylic and ethacrylic acids. Esters of this type include the butyl, 2-ethylhexyl, decyl and lauryl esters of methacrylic and ethacrylic acids. The amount of these plasticizing esters used will depend on the other components of the propellant grain and the specific plasticizing monomer used. Generally, however, from 5% to 20% of plasticizing monomer, based on the weight of the dekenyl acrylate or methacrylate, will provide the desired degree of plasticization.

Other suitable monoethylenically unsaturated monomers including monovinylidene monomers include the following: propyl acrylate, isopropyl acrylate, tert-butyl acrylate, cyclohexyl acrylate, isobornyl acrylate, benzyl acrylate, phenyl acrylate, alkylphenyl acrylate, ethoxymethyl acrylate, ethoxyethyl acrylate, ethoxypropyl acrylate, propoxymethyl acrylate, propoxyethyl acrylate, propoxypropyl acrylate, ethoxyphenyl acrylate, ethoxybenzyl acrylate, ethoxycyclohexyl acrylate, and the corresponding esters of methacrylic acid, styrene, vinyltoluene, vinylnaphthalene, and similar unsaturated monomers.

Copolymers of the above monomers with monovinylene compounds, such as dialkyl maleates, dialkyl fumarates, dialkyl crotonates, dialkyl itaconates, and dialkyl glutaconates are also possible.

The molecular weights of the polymers employed as binders for the propellants of the present invention may be varied over wide ranges and still be within the scope of the invention. The term "molecular weights" as used herein refers to the weight average or viscosity average molecular weights. The polymers may be liquids of low molecular weight, viscous gums of higher molecular weights, to hard and tough solids of very high molecular weight depending on the intended use. Useful polymers can be prepared in which the polymer molecule contains as low as about 5 monomer units, which, depending on the specific monomer employed, is a molecular weight or viscosity molecular weight of about 2000. Polymers which contain as high as 5000 monomers units per polymer molecule are also useful. The preferred range is from 10 to 3000 monomer units per polymer molecule or "chain".

The physical properties of the polymers resulting from polymerizing the monomers of the present invention can be altered by copolymerizing said monomers with polyethylenically unsaturated compounds. Thus, it is possible to obtain cross-linked structures with varying degrees of cross-linking depending on the amount and composition of the polyethylenically unsaturated compounds used. The varying degrees of cross-linking are, in turn, accompanied by varying degrees of thermoplasticity, rigidity and solubility in solvents. The ability to vary the physical properties of the polymers employed in this invention is of importance when they are used as binders for propellant grains.

Suitable polyethylenically unsaturated compounds include the following: divinylbenzene, divinylpyridine, divinyltoluenes, divinylnaphthalenes, diallyl phthalate, ethylene glycol diacrylate, ethylene glycol dimethacrylate, divinylxylene, divinylethylbenzene, divinyl sulfone, polyvinyl or polyallyl ethers of glycol, of glycerol, of pentaerythritol, of mono-, or dithioderivatives of glycols, and of resorcinol, divinylketone, divinylsulfide, allyl acrylate, diallyl maleate, diallyl fumerate, diallyl succinate, diallyl carbonate, diallyl malonate, diallyl oxalate, diallyl adipate, diallyl sebacate, divinylsebacate, diallyl tartrate, diallyl silicate, triallyl tricarballylate, triallyl aconitate, triallyl citrate, triallyl phosphate, N,N'-methylenediacrylamide, N,N'-methylenedimethacrylamide, N,N'-ethylenediacrylamide, 1,2-di(α-methylmethylene sulfonamido)ethylene, trivinylbenzene, trivinylnaphthalene, polyvinylanthracenes, butadiene and isoprene.

The acrylate and methacrylate monomers used in the present invention can be polymerized, either alone or in a mixture with other copolymerizable ethylenically unsaturated compounds using a number of methods well-known to those skilled in the art. Thus, compounds which provide free radicals will initiate polymerization.

Suitable catalysts which provide free radicals which function as reaction initiators include benzoyl peroxide, tert-butyl hydroperoxide, cumene peroxide, tetralin peroxide, acetyl peroxide, caproyl peroxide, tert-butyl perbenzoate, tert-butyl diperphthalate, methyl ethyl ketone peroxide, etc.

The amount of peroxidic catalyst required is roughly proportional to the concentration of the mixture of monomers. The usual range is 0.01% to 3% of catalyst with reference to the weight of the monomer mixture. The preferred range is from 0.2% to 1.5%. The optimum amount of catalyst is determined in large part by the nature of the particular monomers selected, including the nature of the impurities which may accompany said monomers.

Another suitable class of free radical generating compounds are the azo catalysts. There may be used, for example, azodiisobutyronitrile, azodiisobutyramide, azobis(α,α-dimethylvaleronitrile), azobis(α-methylbutyronitrile), dimethyl, diethyl, or dibutyl azobis(-methylvalerate). These and other similar azo compounds serve as free radical initiators. They contain an -N-N- group attached to aliphatic carbon atoms, at least one of which is tertiary. An amount of 0.01% to 2% on the weight of monomer or monomers is usually sufficient.

While suitable physical properties can be obtained by copolymerizing dekenyl acrylates or methacrylates with other ethylenically unsaturated compounds, the specific impulse developed by the propellant grain may be decreased appreciably, particularly if the amount of the other ethylenically unsaturated compounds used be an appreciable portion of the grain. Another method of plasticizing polymers of dekenyl acrylates or methacrylates, which represents the preferred embodiment, uses nitrato esters of alcohols as plasticizers. The alcohols may be monohydric, dihydric or trihydric and it is not necessary to have all of the hydroxyl groups nitrated. The preferred embodiment employs alcohols which do not contain more than ten carbon atoms. Typical plasticizers include dekenylmethyl nitrate, dekenylpropyl nitrate, diethylene glycol dinitrate, triethyleneglycol dinitrate, glycerol dinitrate, butanetriol trinitrate, etc. These nitrato esters are of themselves high energy compounds and so their use causes little reduction in the specific impulse of the grain. The amounts of these plasticizers used will vary with the particular dekenyl monomers employed and the physical properties required in the propellant grain, but will be in the range of about 5% to about 30% on the weight of the dekenyl monomer.

Solvent soluble polymers, which are polyesters or polyesters dissolved in a polymerizable polyvinylidene compound may also be employed as modifiers. Addition polymers from maleic or fumaric acid and one or more alkylene glycols with or without another dibasic acid are well known. Useful glycols include ethylene, propylene, butylene, diethylene, and triethylene glycols or mixed glycols having ethylene and other alkylene groups. While the polyester may be a maleic-glycol condensate, it may also be a condensate of maleic acid (or anhydride), glycol, and such a dibasic acid as adipic, azelaic, sebacic, succinic, or phthalic acid.

The polyester may be supplemented with one or more polyvinylidene compounds, such as diallyl phthalate, diallyl maleate, allyl diglycol carbonate, allyl succinyl, allyl glycolate, diallyl succinate, divinylbenzene, and similar polyvinylidene compounds in which the polyester is dissolved and which can itself enter into copolymerization. Mixtures in proportions from 80:20 to 25:75 by weight of polyester to polyvinylidene monomer are especially useful.

The purpose of the multiply olefinically unsaturated component is to provide the proper degree of cross-linking of the final copolymer to render it form-stable and stable against changes in temperatures, pressures, and mechanical forces encountered in handling, firing, and dispatching rocket motors. At the same time this component plays a part in bonding the final copolymer to a casing.

As set forth hereinbefore, the monomers employed in the present invention, when polymerized, are valuable as high energy binders for propellant grains. They are used in conjunction with an oxidizer, which oxidizer may vary widely in chemical composition.

The oxidizer is an essential component for providing good burning and high impulse. It may be a nitrate, usually inorganic, such as ammonium, sodium or potassium nitrate, or a percholate, such as ammonium, sodium, and potassium perchlorate or mixtures of two or more of such oxidizing agents. These may be supplemented or replaced with an organic oxidizer such as nitroguanidine, pentaerythritol tetranitrate, or cyclotrimethylenetrinitramine.

The nitrates and perchlorates are available or are readily prepared in different particle sizes. Relatively coarse particles may be used when it is desired to provide relatively slow burning rates. Some differences in burning rates also result from the choice of salt used as oxidizer.

Thus, it becomes possible to provide propellant compositions which vary over the widest range of burning rates. Such control of burning rates and wide range of burning rates is possible because of the high burning rate and specific impulse which are possible as a result of the combination of ingredients or components used in the compositions of this invention.

The oxidizer is prepared in the particle size or sizes which may be desired. If desired, the oxidizer may be dried at any stage. In general, drying at the temperature of low pressure steam (100° – 110° C.) is sufficient, a moisture content of not over 0.05% being sought. If necessary, the oxidizer is crushed or ground and desirably sieved to ensure uniformity and reproducibility.

The particles of oxidizer or oxidizers may vary in size from about 5 microns to about 400 microns. In general, particles of oxidizer will pass at least a 40 mesh screen and preferably a 60 mesh screen. The particles may be fairly uniform as to size or mixtures of different sizes may be used.

Although presenting greater handling problems, liquid oxygen and liquid fluorine are also very efficient oxidizers.

The presence of stabilizer and of polymerization inhibitor in the composition is desirable, this latter particularly when the primary mixture is to be stored or shipped to a point at which it will be heated, shaped, and converted to a fixed polymeric form. The usual stabilizers for nitro compounds can be advantageously used in amount from 0.1 to about one part per 100 parts of the compositions. Typical stabilizers are sym-diphenylurea and sym-diphenyldiethylurea.

The inhibitor is one such as p-methoxyphenol, hydroquinone, quinone, N-nitrosodiphenylamine, or di-$\beta$-naphthol. The proportion of inhibitor used may be determined with reference to the particular composition, the inhibitor being best proportioned to the amount of monomer present and to the time of storage to which the primary mixture will be subjected. Amounts from about 0.002 part to 0.1 part provide a useful range.

Addition of solid combustible particles to the primary composition is often highly desirable. Such particles perform a number of functions in both the primary compositions and the fixed compositions. Solid combustible particles are especially desirable and useful in large grains or individual castings. One purpose they serve is to prevent resonant burning. This avoids the need for using special equipment such as resonance rods to deal with this problem and thus avoids the added weight of such equipment. Another function of the solid particles is to supply a source of energy, since at the flame temperatures produced in the burning of these particular compositions, these particles can also burn.

The presence of the combustible solid particles provides a ballistic modifier which changes or controls ballistic characteristics which include type of burning and burning rate, specific impulse, and pressure and temperature coefficients of burning rate. Opaque solids have a definite influence on the effects of radiation.

Furthermore, the solid particles, particularly when in leaf form, may assist in suspending coarse pieces of oxidizer, as when it is desired to use an oxidizer in relatively coarse form to provide a slower rate of burning. The solid particles have other influences on the physical nature of the compositions, acting as strengthening and reinforcing solids.

The metals may be in the form of amorphous or crystalline powders or in leaf form, such as is used for preparing leafing pigments or powders for paints. Particle sizes may vary from about one micron with average particle sizes of about 10 to 20 microns. Leafing powders have been found effective from one completely passing a 325 mesh screen to one giving 90% through a 325 mesh screen and 95.5% through a 100 mesh screen.

Atomized or powdered metals meeting similar specifications for particle size are also useful. This form of metal has little influence on the viscosity of the primary composition when in a melted or fluid form and, therefore, permits a considerable proportion of combustible solid in the compositions without interfering with the flow of primary compositions. Typical of such combustible solids are carbon, lithium, aluminium, magnesium, zinc, zirconium, and boron.

It is necessary that a practical propellant meet other criteria, such as thermal stability, storage stability, stability during preparation, insensitiveness to impact, freedom from toxicity to workers preparing the compositions and to those using them, and low pressure and temperature coefficients of burning rates. Also, when the compositions have once been placed within a motor case, they must maintain their given form under wide extremes of temperature and they must be stable to withstand the tremendous accelerations to which they will be exposed during firing.

A necessary requirement is that a propellant be formed without voids, cracks, or fissures. One consequence of such defects is that the propellant charge may detonate upon firing. Again, if a propellant possesses such faults and should be fired apparently successfully, the charge tends to break up with ejection of unburned chunks and the full energy of the propellant cannot be utilized.

To meet with the above and other requirements, there is first formulated a primary composition which can be stored, transported, and finally placed and cured in a motor when and where desired. The primary composition is converted into a fixed composition in the form of grains or of a grain when it is cured. This fixed composition is used as a propellant.

The primary composition is fluid as first prepared or when it is heated. In a fluid state, it may be mixed with a free radical polymerization initiator, cast into a mold or a casing which serves as both mold and container, and cured by heating. If desired, the primary composition when cast in a motor casing is case-bonded thereto and this is one of the important advantages of the compositions of this invention. During the curing step unsaturated components of the primary mixture are polymerized together. The fixed composition is stable, useful and effective over a wide range of temperatures, such as −30° to 60° C.

The propellant compositions of the present invention are characterized by extremely fast burning rates. As will be noted from Table VII particularly, the burning rates are in the range of 2.5 to 3.6 in./sec. at 1000 psi. This is a completely unexpected result, since the usual burning rates of composite propellants are in the range of 0.2 to 0.5 in./sec. at 1000 psi. This characteristic, combined with the other desirable physical and chemical properties of these compositions, makes them ideally suited for use in such fast burning compositions as "cigarette burners", i.e., solid charges which burn from one end when cast into rocket motors. Because such solid charges can be prepared, loading densities are 100% as compared with loading densities between 80% and 90% when charges contain a central perforation. The development of cigarette burning charges has long been desirable in the field of solid propellants but has not been practical because of the low burning rates of the propellant compositions available. These propellants would also be useful in weapons, such as the Bazooka, which because of the high mass discharge rates required must contain multi-grain charges. With burning rates of the order of 3 in./sec. at 1000 psi., multi-grain charges would still be necessary, but fewer grains having a larger diameter could be used thereby giving stronger charges and reducing manufacturing problems.

PREPARATION OF INTERMEDIATES AND MONOMERS

Preparation of Dekenylmethyl Acetate

Into a 3 liter, three-necked round-bottom flask, equipped with a reflux condenser, a dropping funnel, a mechanical stirrer, and a wet test meter was placed 228 grams (1.86 moles) of decaborane (Technical Grade) dissolved in 2 liters of acetonitrile (distilled over $P_2O_5$).

The solution was brought to reflux with stirring, and 205 grams (2.1 moles) of propargyl acetate was added dropwise over a one and one-half hour period. The solution was refluxed for an additional three hours at the end of which time gas evolution was very slight. The clear orange solution was cooled and the majority of the acetonitrile distilled off under reduced pressure. To the resulting viscous liquid was slowly added approximately 400 ml. of 10% KOH. This mixture was extracted three times with 500 cc. portions of pentane. The combined extracts were then washed with 300 ml. of 10% NaOH, separated, and dried over anhydrous magnesium sulfate. After filtration and removal of the pentane solvent under reduced pressure, there was obtained approximately 245 grams of dekenylmethyl acrylate which was a low-melting, slightly yellow solid. This represents a 60% yield, based on decaborane. Recrystallization was effected from pentane giving a white crystalline solid of m.p. 47° to 48° C.

Anal. Calc'd. for $C_5H_{18}B_{10}O_2$: C, 27.50; H, 8.31; B, 49.54. Found: C, 28.04; H, 7.71; B, 49.45.

Preparation of Dekenylmethanol

Into a 2 liter, three-necked flask equipped with a condenser, a mechanical stirrer, a dropping funnel, and a nitrogen inlet bubbler was placed 15.0 grams of $LiAlH_4$ and 600–700 ml. of anhydrous ether. The solution was then refluxed under dry nitrogen for approximately one-half hour to dissolve the $LiAlH_4$. To this was added a solution of 93 grams (0.43 mole) of dekenylmethylacetate in 300 ml. of anhydrous ether at a rate which allowed the maintenance of a moderate reflux. After addition was complete, the mixture was stirred for an additional one-half hour. Methanol was then added slowly to the reaction mixture until reaction ceased. The resulting solution was poured into water and concentrated HCl was added until the solid was completely dissolved. The ether layer was separated and the aqueous layer extracted with ether. The combined ether extracts were then dried over anhydrous magnesium sulfate, filtered, and the ether removed under reduced pressure. The dekenylmethanol which was obtained weighed 70.0 grams, representing approximately a 93% yield. A sample of this material was twice recrystallized from pentane giving waxy plates having a m.p. of 221° to 223° C.

Anal. Calc'd. for $C_3H_{16}B_{10}O$: C, 20.43; H, 9.15; B, 61.35. Found: C, 21.46; H, 8.60; B, 60.02.

Diethinyl Carbinyl Acetate

To a 200 ml. three-necked flask fitted with mechanical stirrer, reflux condenser with protective Drierite drying tube and dropping funnel was introduced 15.0 grams (0.1875 mole) diethinyl carbinol, 17.0 grams (0.215 mole) pyridine and 100 ml. dry ether. The reaction mixture was cooled to 0° to 5° C. using an ice-water bath. To the mixture was added 16.0 grams (0.204 mole) acetyl chloride at such a rate that the temperature was maintained below 10° C. The reaction was then completed by allowing it to stand for a period of three hours at room temperature. The reaction mixture was washed with water and extracted with ether. The ether extracts were combined and dried over anhydrous magnesium sulfate. After removal of the ether, the liquid residue was vacuum distilled. The product, diethinyl carbinyl acetate, b.p. 39° to 40° C. (2–3 mm.), $n^{20}$ 1.4426 was collected. Its infrared spectrum and elemental analysis were consistent for the desired product, diethinyl carbinyl acetate. The yield was 16.4 grams (71.5%).

Anal. Calc'd. for $C_7H_6O_2$: C, 68.75; H, 4.92. Found: C, 68.88; H, 5.33.

Didekenyl Carbinyl Acetate

A solution of 6.0 grams (0.491 mole) decaborane in 60 ml. dry acetonitrile was introduced into a 100 ml. flask fitted with magnetic stirrer, reflux condenser with protective Drierite drying tube, dropping funnel and gas-inlet tube. The reaction flask was flushed thoroughly with nitrogen and the nitrogen flow continued during the entire reaction. The reaction temperature was then increased to reflux and immediately an acetonitrile diethinyl carbinyl acetate solution (25 ml. – 3.0 grams) (0.245 mole) added over the course of fifteen minutes. The reaction was maintained at reflux for a period of 5½ hours. On cooling the acetonitrile was removed and the residue neutralized slowly by the addition of excess of cold 10% sodium hydroxide with external cooling in an ice-water bath. The aqueous solution was then placed in a liquid-liquid extractor with pentane and extraction continued for seventy-two hours. The pentane extracts were dried over magnesium sulfate after which the pentane was evaporated leaving a liquid residue of 5.73 grams (65.5% yield of didekenyl carbinyl acetate).

Didekenyl Carbinol

To a 200 ml. three-necked flask equipped with magnetic stirrer, reflux condenser with protective Drierite drying tube and dropping funnel was introduced 100 ml. anhydrous ether and 3.8 grams (0.1 mole) lithium aluminum hydride. The ether was brought to reflux for a period of one hour after which a solution of 14.38 grams (0.0394 mole) didekenyl carbinyl acetate in 25 ml. anhydrous ether was added dropwise to the reaction flask. The reaction was continued for two hours after the addition was completed. Methanol was then added to remove the excess lithium aluminum hydride. The reaction was then added slowly to cold dilute hydrochloric acid and extracted with ether. The ether extracts were dried over magnesium sulfate, then the ether was removed to yield 16.2 grams of oily residue. The infrared spectrum of the residue showed that the desired product, didekenyl carbinol, had been obtained. The product was recrystallized from pentane, m.p. 185° to 187° C.

Anal. Calc'd. for $C_5H_{28}B_{20}O$: C, 18.75; H, 8.75; 19.61; B, 67.5. Found: C, 1961; H, 7.47; B, 66.7.

Preparation of Didekenyl Carbinyl Acrylate

To a 200 ml. three-necked flask equipped with magnetic stirrer, reflux condenser with protective Drierite drying tube and dropping funnel was added 3.20 grams (0.01 mole) dekenyl carbinol, 100 ml. anhydrous ether and 0.84 gram (0.01 mole) phenyl lithium. After standing for thirty minutes with stirring 0.91 gram (0.01 mole) of acryloyl chloride was added dropwise with external cooling of the reaction mixture in an ice-water bath. The reaction was completed on standing for two hours. The mixture was washed with water, then the ether layer dried over magnesium sulfate followed by removal of the ether to give an oily residue whose infrared spectrum was consistent with that expected of didekenyl carbinyl acrylate. Crude yield was 3.68 grams. The oily residue crystallized in part on standing overnight and was almost completely crystalline on standing for 72 hours. Several attempts to recrystallize were unsuccessful. The residue was then permitted to stand until partly crystallized. The crystalline material was washed several times with cold pentane and collected by filtration, m.p. 114° to 116° C.

Anal. Calc'd. for $C_8H_{30}B_{20}O_3$: C, 25.62; H, 8.01; B, 57.70. Found: C, 26.52; H, 7.58; B, 55.00.

Preparation of Dekenylmethyl Acrylate

A solution consisting of 68 grams (0.39 mole) of dekenylmethanol, 45.0 grams (0.44 mole) of triethylamine, a small amount of inhibitor and 250 ml. of acetonitrile (distilled over $P_2O_5$) was placed in a one liter, three-necked, round-bottom flask equipped with a condenser, a mechanical stirrer, and a dropping funnel. To this solution was slowly added with stirring and under dry nitrogen a solution of 45.0 grams (0.56 mole) of acryloyl chloride in 100 cc. of acetonitrile (distilled over $P_2O_5$) at such a rate that moderate reflux was maintained. After the addition was complete, stirring was continued for one hour during which time the reaction cooled to room temperature. The reaction mixture was poured into an ice water-ether mixture and concentrated HCl was added until the solution was acid to litmus. The resulting ether layer was separated and the aqueous layer extracted once with additional ether. The combined ether extracts were then washed with water, separated, and dried over anhydrous magnesium sulfate followed by removal of the ether under reduced pressure. The oil which resulted weighed 82.0 grams representing a 91% yield based on decaborane. This oil was stirred with water at room temperature for approximately 2 hours after which ether was added and the aqueous layer separated. The ethereal solution was washed with sodium carbonate solution, separated, and dried followed by removal of the ether. The resulting oil to which a small amount of inhibitor was added was distilled in a "short path" vacuum distillation apparatus. Approximately 75 cc. of dekenyl methyl acrylate distilled over at 85° to 90° C. at $10^{-4}$ to $10^{-5}$ mm. Hg. using a pot temperature of approximately 125° C. This liquid crystallized to a solid which had a m.p. of 17° to 18° C.

Preparation of Didekenylmethyl Carbinyl Acrylate

Into a three-necked flask equipped with a reflux condenser, dropping funnel and magnetic stirrer was placed 34.8 grams of didekenylmethyl carbinol and 200 ml. of dry ether. The system was flushed with dry nitrogen and 90 ml. of 1.11 molar phenyllithium solution was added dropwise. After the addition, the reaction mixture was stirred for thirty minutes and 12.0 grams of acryloyl chloride and 50 ml. of ether was added slowly. The reaction mixture was stirred overnight. It was then poured into water, the ether solution was washed with water, dried over magnesium sulfate, and the solvent removed. Pentane was added to the residue and the solid filtered off, washed with pentane and dried. The weight of the didekenylmethyl carbinyl acrylate obtained was 15.5 grams. A sample was recrystallized from ethanol three times. M.p. 148° to 150° C.

Anal. Calc'd. for $C_{10}H_{34}B_{20}O_2$: C, 29.82; H, 8.51; B, 53.73. Found: C, 30.40; H, 7.73; B, 54.12.

An equimolar quantity of methacryloyl bromide was substituted for the acryloyl chloride in the foregoing experiment. Didekenylmethyl carbinyl methacrylate was obtained in good yield.

Molar equivalents of butyllithium, fluorenyllithium, trityllithium and naphthalenelithium were substituted for the phenyllithium in the foregoing experiment with equally saatisfactory results.

The following examples are illustrative of the present invention and are presented for purposes of illustration and not by way of limitation. Parts are by weight unless otherwise indicated.

EXAMPLE I

The compositions set forth in Table I (all parts are parts by weight) were prepared by mixing all the components at a temperature of 30° C. until a uniform mixture was obtained and cast into "motors" which were 2.0 inches in diameter and 4 inches long. The propellant was cured in the motor at 60° C. for 48 hours, and then subjected to standard ballistic tests. The results of these tests are recorded in Table I.

TABLE I

| | PROPELLANT COMPOSITIONS | | | |
|---|---|---|---|---|
| | MVD-6 | MVD-7 | MVD-8 | MVD-9 |
| Ammonium Perchlorate | 74.2 | 69.27 | 72.0 | 67.36 |
| Dekenylmethyl acrylate | 15.5 | 18.44 | 16.8 | 13.58 |
| Dekenylpropylnitrate | 10.3 | 12.29 | 11.2 | 9.05 |
| Aluminum | 10.3 | 12.29 | 11.2 | 10.00 |
| K | 29.8 | 30.7 | 28.4 | 27.9 |
| $r_b$ | 2.402 | 1.068 | 1.863 | 1.525 |
| $P_{max}$ | 1316. | 469. | 829. | 692. |
| $P_b$ | 607. | 300. | 460. | 399. |
| c* | 5165. | 5080. | 5139. | 4961. |
| $F_{1000}^0$ | 246.5 | 242.3 | 236.2 | 237.3 |
| $C_F^0$ | 1.535 | 1.534 | 1.478 | 1.538 |

Although ammonium perchlorate was used as the oxidizer in these tests to permit comparison of the results with those on other propellants, it should be understood that other oxidizers, including those set forth hereinbefore, can be satisfactorily employed.

EXAMPLE II

Propellants of the compositions set forth in Tables II and III were prepared and tested as set forth in Example I. The ballistic data on these compositions are set forth in Tables IV and V.

TABLE II

| | Composition of Dekenylmethyl Acrylate Propellants | | | |
|---|---|---|---|---|
| | No. 5 | No. 6 | No. 7 | No. 8 |
| Dekenyl methyl acrylate | 19.6 | 15.3 | 18.44 | 16.8 |

TABLE II-continued

| Composition of Dekenylmethyl Acrylate Propellants | No. 5 | No. 6 | No. 7 | No. 8 |
|---|---|---|---|---|
| Methyl dekene | 4.0 | | | |
| Butanetriol trinitrate | 8.4 | | | |
| Ammonium Perchlorate | 68.0 | 74.2 | 69.27 | 72.0 |
| Dekenyl propyl nitrate | | 10.3 | 12.29 | 11.2 |
| Balance point | $HBO_2$, CO $H_2$ | $HBO_2$ CO $H_2$ | $B_2O_3$ CO $H_2$ | Inter $HBO_2$ $B_2O_3$ |

TABLE III

| Composition of Dekenylmethyl Acrylate Propellants | No. 11 | No. 13 | No. 14 |
|---|---|---|---|
| Dekenyl methyl acrylate | 15.45 | 21.0 | 22.4 |
| Dekenyl propyl nitrate | 10.30 | | |
| Triethylene glycol dinitrate | | 19.0 | 9.6 |
| Ammonium perchlorate | 74.25 | 65.0 | 68.0 |
| Ferric oxide | 0.50 | | |
| Balanced | $HBO_2$, CO, $H_2$ | $HBO_2$, CO, $H_2$ | $HBO_2$, CO, $H_2$ |

TABLE IV

| Ballistic Data on Dekenylmethyl Acrylate Propellants | No. 5 | No. 6 | No. 7 | No. 8 |
|---|---|---|---|---|
| $K_a$ | 29.6 | 29.8 | 30.7 | 28.4 |
| $r_b$(in/sec) | 1.2 | 2.4 | 1.1 | 1.9 |
| $P_{max}$(PSI) | 425 | 1316 | 469 | 829 |
| $P_b$ | 305 | 607 | 300 | 460 |
| C* | 4672 | 5165 | 5080 | 5139 |
| $F_n$($lb_f$) | 223 | 389 | — | — |
| $I_{1000}^0$(sec) | 243.4 | 246.5 | 242 | 236 |
| Balance Point | $HBO_2$, CO, $H_2$ | $HBO_2$, CO, $H_2$ | $B_2O_3$, CO, $H_2$ | Inter $HBO_2$ $B_2O_3$ |

TABLE V

| Ballistic Data on Dekenylmethyl Acrylate Propellants | No. 11 | No. 13 | No. 14 |
|---|---|---|---|
| K | — | 60 | 63 |
| $r_b$(in/sec) | 2.91 | 2.99 | 3.20 |
| $P_{max}$(PSI) | — | 1661 | 1977 |
| $P_b$ | 577 | 1383 | 1573 |
| C* | — | 4963 | 4858 |
| $I_{1000}^0$(sec) | 240.6 | 240 | 241 |

EXAMPLE III

There are charged to a jacketed kettle 10 parts of 1,3,4butanetriol trinitrate. The kettle is heated withh water in the jacket at 25°–40° C. The charge is stirred and thereto are added 0 to 3 parts of a polyester resin composition prepared by mixing (*a*) 50% of a condensate of phthalic and maleic anhydride and propylene glycol and (*b*) 50% of diallyl phthalate, 15 parts of dekenylmethyl acrylate and 0.02 part of p-methoxyphenol. After the above material is thoroughly mixed, there is stirred into the mixture 75 parts of ammonium perchlorate of 65 micron average particle size. The mixture is now subjected to reduced pressure down to 10 mm. After vacuum mixing, 0.5 to 1.0 parts/polymerizable material of a peroxide polymerization initiator, such as benzyl peroxide, is added and the mixture is again stirred under reduced pressure.

The above mixture is cast or allowed to flow into a motor casing which has been sand-blasted, cleaned with acetone and dried. Within the casing, a mandrel has been placed to impart a desired shape at the center of the final fixed composition. When the batch has been placed within the casing, it was kept for 48 hours at 60° to 75° C. The mandrel was withdrawn, the top of the casting was trimmed and coated with a plastic, such as polysulfide rubber, a nozzle was attached to the casing and necessary accessories installed for ignition, pressure recording and thrust measurement.

The cured composition is a tough, rubbery solid which is tightly held by the casing. When it is ignited with the aid of an ignitor, it burns progressively giving a specific impulse of 250 lbf-sec/lbm.

The procedure used in Example III is followed for the preparation of compositions shown in Table VI.

TABLE VI

| Typical Compositions Containing Ammonium Perchlorate Parts by Weight | | | | |
|---|---|---|---|---|
| Ingredient | Ex. IV | Ex. V | Ex. VI | Ex. VII |
| Butanetriol trinitrate | 9.6 | 19.0 | 9.0 | 10.2 |
| dekenylmethyl acrylate | 22.4 | 20.5 | 13.5 | 15.3 |
| Polyester | | 0.5 | 0.5 | 0.3 |
| Ammonium perchlorate | 68.0 | 65 | 67.0 | 74.2 |
| Aluminum | | | 10.0 | |

Butanetriol trinitrate may be replaced with one or more other nitrated plasticizers or supplemented with one or more of the ester or ether ester plasticizers set forth hereinbefore.

Examples of other plasticizers and the burning rate of the compositions are given in Table VII.

TABLE VII

Examples of Other Plasticizers and Burning Rates Obtained Therewith

| Ingredient | Parts by Weight Ex. VIII | Ex. IX | Ex. X | Ex. XI | Ex. XII |
|---|---|---|---|---|---|
| Dekenylmethyl acrylate | 15.5 | 18.4 | 13.6 | 21.0 | 20.0 |
| Dekenylpropyl nitrate | 10.3 | 12.3 | 9.0 | | |
| Triethyleneglycol dinitrate | | | | 18.5 | |
| Diethyleneglycol dinitrate | | | | | 9.6 |
| Polyester | | | | 0.5 | 0.4 |
| Ammonium perchlorate | 74.2 | 67.3 | 67.4 | 65.0 | 70.0 |
| Aluminum | | | 10.0 | | |
| Burning rate, in./sec. 1000 psi | 3.6 | 3.1 | 3.3 | 2.5 | 2.9 |

The aluminum used is finely divided. In Examples VI and X, it is in both leaf and atomized form, 99% of which passes a 325 mesh screen.

The ammonium perchlorate may be of any of several average particle sizes from 250 microns to 10 microns and combinations thereof.

If desired, to any of the above compositions, there may be added 0.01 to 0.5 part of polymerization inhibitor. Such addition is particularly desirable when the compositions are to be stored or transported in the unpolymerized state.

I claim:

1. Polymerizable combustible compositions, suitable for the manufacture of propellants, consisting essentially of a mixture of (1) 10 to 50 parts of a monomer of the formula:

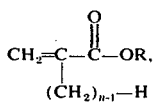

in which $n$ is 1 to 2 and R is a radical selected from the group consisting of $(H\not{D}CH_2)_2CH$—,
$(H\not{D})_2CH$—,
$H\not{D}CH_2$—,
$H\not{D}(CH_2)_2$—,
$H\not{D}(CH_2)_3$,
$H\not{D}(CH_2)_4$,
$H\not{D}(CH_2)_5$—, and
$(CH_3\not{D})_2CH$— in which formulas —$\not{D}$— represents

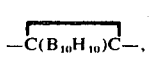

(2) 0.1 to 3 parts of a polymerizable soluble multiply ethylenically unsaturated polyester selected from the group consisting of (1) 25 to 80 parts by weight of addition polymers of acids selected from the group consisting of maleic, fumaric, adipic, azelaic, sebacic, succinic and phthalic acids and mixtures thereof with glycols selected from the group consisting of ethylene, propylene, butylene, diethylene and triethylene glycols and mixtures thereof dissolved in (2) 20 to 75 parts by weight of a polyvinylidene composition selected from the group consisting of diallyl phthalate, diallyl maleate, diallyl succinate and divinylbenzene, (3) 5 to 25 parts of a nitrato ester of an alcohol containing not more than 10 carbon atoms, said alcohol having not more than three hydroxyl groups, (4) 50 to 80 parts of an oxidizer selected from the group consisting of solid inorganic oxidizing salts, nitroguanidine, pentaerythritol tetranitrate and cyclotrimethylenetrinitramine and mixtures thereof, (5) 0 to 25 parts of a finely particled readily combustible solid selected from the group consisting of carbon, lithium, aluminum, magnesium, zinc, zirconium and boron.

2. Polymerizable combustible compositions as set forth in claim 1 which contain 0.1 to 1 part of a chemical stabilizer for nitrato compounds.

3. Polymerizable combustible compositions as set forth in claim 1 which contain 0.002 to 0.1 part of a compound which inhibits the polymerization of ethylenically unsaturated compounds.

4. Polymerizable combustible compositions as set forth in claim 1 which there is present 1 to 25 parts of aluminum powder.

5. Polymerizable combustible compositions as set forth in claim 5 in which the aluminum powder is a mixture of a leafing powder and an atomized powder.

6. Propellant compositions consisting essentially of, as a binder, a copolymer of A) 10 to 50 parts of a monomer of the formula

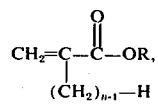

in which $n$ is 1 to 2 and R is a radical selected from the group consisting of $(H\not{D}CH_2)_2CH$—,
$(H\not{D})_2CH$—,
$H\not{D}CH_2$—,
$H\not{D}(CH_2)_2$—,
$H\not{D}(CH_2)_3$,
$H\not{D}(CH_2)_4$,
$H\not{D}(CH_2)_5$—, and
$(CH_3\not{D})_2CH$— in which formulas —$\not{D}$— represents

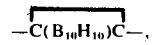

B. 0.1 to 3 parts of a polymerizable soluble multiply polyethylenically unsaturated polyester selected from the group consisting of (1) 25 to 80 parts by weight of addition polymers of acids selected from the group consisting of maleic, fumaric, adipic, azelaic, sebacic, succinic and phthalic acids and mixtures thereof with glycols selected from the group consisting of ethylene, propylene, butylene, diethylene, and triethylene glycols and mixtures thereof dissolved in (2) 20 to 75 parts by weight of a polyvinylidene composition selected from the group consisting of diallyl phthalate, diallyl maleate, diallyl succinate and divinylbenzene, said copolymer being plasticed with 5 to 25 parts of a nitrato ester of an alcohol containing not more than 10 carbon atoms, said alcohol having not more than 3 hydroxyl groups, having dispersed uniformly therethrough 50 to 80 parts of an oxidizer selected from the group consisting of solid inorganic oxidizing salts, nitroguanidine, pentaerythritol tetranitrate and cyclotrimethylenetrinitramine and mixtures thereof, and also having dispersed therethrough 0 to 25 parts of a finely-particled, readily-combustible solid selected from the group consisting of carbon, lithium, aluminum, magnesium, zinc, zirconium and boron.

7. A propellant composition as set forth in claim 6 in which the plasticizer is triethyleneglycol dinitrate.

8. Propellant compositions as set forth in claim 6 in which there is present 1 to 25 parts of aluminum powder.

9. Propellant compositions as set forth in claim 8 in which the aluminum powder is a mixture of a leafing powder and an atomized powder.

10. Propellants consisting essentially of compositions having (1) as binders therefor, polymers of the formula

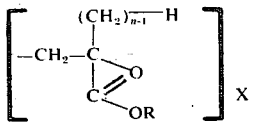

in which $n$ is 1 to 2, X is about 5 to 3000, and R is a radical selected from the group consisting of $(H\not{D}CH_2)_2CH—$,
$(H\not{D})_2CH—$,
$H\not{D}CH_2—$,
$H\not{D}(CH_2)—$,
$H\not{D}(CH_2)_3$,
$H\not{D}(CH_2)_4$,
$H\not{D}(CH_2)_5—$, and
$(CH_3\not{D})_2CH—$, in which formulas $—\not{D}—$ represents $$—\overbrace{C(B_{10}H_{10})C}—,$$

and (2) containing, intimately admixed therewith, an oxidizer selected from the group consisting of solid inorganic oxidizing salts, nitroguanidine, pentaerythritol tetranitrate and cyclotrimethylenetrinitramine and mixtures thereof in an amount sufficient to effect complete oxidation of said binders.

* * * * *

UNITED STATES PATENT AND TRADEMARK OFFICE

CERTIFICATE OF CORRECTION

PATENT NO. : 3,967,989

DATED : July 6, 1976

INVENTOR(S) : MARION F. HAWTHORNE

It is certified that error appears in the above-identified patent and that said Letters Patent are hereby corrected as shown below:

Column #10, Line 6 - "(0.491 mole)" should be "(0.0491 mole)".

Column #10, Line 50 - "Found: C,1961;" should be "Found: C, 19.61;"

Column #17, Formula -

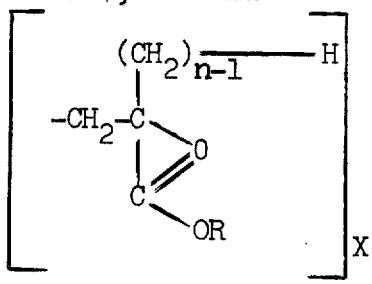

should be

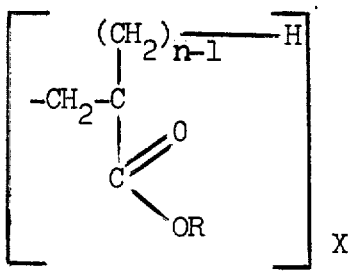

Signed and Sealed this

Fifteenth Day of March 1977

[SEAL]

*Attest:*

RUTH C. MASON
*Attesting Officer*

C. MARSHALL DANN
*Commissioner of Patents and Trademarks*